US005148971A

United States Patent [19]

Ahn

[11] Patent Number: 5,148,971

[45] Date of Patent: Sep. 22, 1992

[54] BEVERAGE CARTON WITH TELESCOPIC FLOATING STRAW

[75] Inventor: Si Yoll Ahn, 221-06 58th Ave. (1st Floor), Bayside, N.Y. 11364

[73] Assignee: Si Yoll Ahn, Bayside, N.Y.

[21] Appl. No.: 762,432

[22] Filed: Sep. 19, 1991

[51] Int. Cl.[5] ..... B65D 5/72

[52] U.S. Cl. ..... 229/103.1; 215/1 A; 239/33

[58] Field of Search ..... 239/33; 229/103.1; 215/1 A; 220/90.2; 206/621.1, 621.2, 631.3

[56] References Cited

U.S. PATENT DOCUMENTS

| | | | |
|---|---|---|---|
| 2,194,011 | 3/1940 | Davidson | 229/103.1 |
| 2,392,479 | 1/1946 | Humbert | 229/103.1 |
| 2,450,244 | 9/1948 | Lynch | 229/103.1 |
| 2,547,362 | 4/1951 | Berry | 229/103.1 |
| 2,613,988 | 10/1952 | Jarbeau | 215/1 A |
| 2,799,439 | 7/1951 | Pugh, Sr. | 229/103.1 |
| 2,805,809 | 9/1957 | Pugh | 229/103.1 |
| 3,189,171 | 6/1965 | Miller | 229/103.1 |
| 3,215,329 | 11/1965 | Pugh, Sr. | 229/103.1 |
| 3,303,984 | 2/1967 | Jurena | 229/103.1 |
| 3,303,985 | 2/1967 | Prokes et al. | 229/103.1 |
| 3,325,076 | 6/1967 | Soucy | 229/103.1 |
| 3,486,679 | 12/1969 | Pfahler | 229/103.1 |
| 3,542,278 | 11/1970 | Deaver . | |
| 3,656,654 | 4/1972 | Brinkley, III | 229/103.1 |
| 3,770,185 | 11/1973 | Reeves . | |
| 4,226,356 | 10/1980 | Lemelson | 229/103.1 |
| 4,228,913 | 10/1980 | Mack et al. | 229/103.1 |
| 4,244,474 | 1/1981 | Wise . | |
| 4,305,521 | 12/1981 | Komatsuta et al. | 229/103.1 |
| 4,356,927 | 11/1982 | Cooper et al. | 220/90.2 |
| 4,462,503 | 7/1984 | Di Raffaele et al. | 229/103.1 |
| 4,690,294 | 9/1987 | Jones | 229/103.1 |
| 4,850,533 | 7/1989 | Hoshi et al. | 239/33 |
| 4,877,148 | 10/1989 | Larson et al. | 220/90.2 |

FOREIGN PATENT DOCUMENTS

| | | | |
|---|---|---|---|
| 464569 | 4/1950 | Canada | 229/103.1 |
| 753099 | 2/1967 | Canada | 229/103.1 |
| 172395 | 2/1986 | European Pat. Off. | 239/33 |
| 1024768 | 4/1953 | France | 215/1 A |
| 634397 | 2/1962 | Italy | 215/1 A |
| 7908774 | 7/1981 | Netherlands | 239/33 |

*Primary Examiner*—Gary E. Elkins

[57] ABSTRACT

A drinking straw contained in a beverage carton having a flexible portion (2) and a buoy (8). The carbon has a clamp (17) and a straw retainer (18) that holds the straw vertically inside the carton. When the carton is opened the straw (1) comes up immediately to an ideal drinking position. The consumer has the option of extending the straw, which consists of two telescopically engaged tubes.

1 Claim, 2 Drawing Sheets

BEVERAGE CARTON WITH TELESCOPIC FLOATING STRAW

BACKGROUND

1. Field of Invention

This invention relates to beverage cartons, specifically to to drinking through the use of a telescopic floating straw already contained in the carton.

2. Description of Prior Art

Beverage cartons have been used for decades to contain milk, juices, and other beverages. Most people drink from cartons using straws (especially the 1 pint fruit juice cartons), but beverage cartons do not come with them requiring consumers to ask for them or many times buy them separately which is a tremendous inconvenience and time consuming process.

Furthermore, since the straws come in individual wraps the consumer is required to use his/her fingers to tear off the protective wrap and insert it in the carton. The process of touching the straw with fingers can create an unhealthy situation if one does not have a properly washed hand.

Therefore, to make this process simpler and more convenient many inventions were conceived and patented in this field:

| Patent No. | Patentee | Issue Date |
|---|---|---|
| 3,770,185 | Reeves | 11/06/73 |
| 4,244,474 | Wise | 1/13/81 |
| 3,542,278 | Deaver | 11/24/70 |

Reeves U.S. Pat. No. 3,770,185 discloses a carton with a straw hole on the roof of the it in which, a straw is inserted through the hole in order to drink from it. His invention does not relate to cartons equipped with straws.

Wise U.S. Pat. No. 4,244,474 also discloses a carton with a straw hole similar to Reeves', therefore not relating to cartons equipped with straws.

Deaver U.S. Pat. No. 3,542,278 discloses a carton with a built-in straw. He uses a straw that is attached to the roof of the carton from the inside so that when the adhesive pull tab that covers the hole is detached the straw is extended out of the carton. His invention requires consumers to pull the straw, while the "Beverage Carton With Telescopic Floating Straw" only requires consumers to open the carton as usual and the floating straw will immediately come up to an ideal drinking position.

OBJECTS AND ADVANTAGES

Accordingly, besides the objects and advantages of the "Beverage Carton With Telescopic Floating Straw" described above, several other objects and advantages are:

(a) To provide a beverage carton containing a straw that is virtually hands-free. Consumers won't have to touch the straw with fingers in any moment making it the safest and healthiest way to drink any beverage.

(b) To provide a floating straw that comes up accurately to an ideal drinking position immediately after the carton is opened.

(c) To provide a straw holder that will securely hold the straw in place even during impacts, and to guide the straw out of the carton immediately after the carton is opened.

Further objects and advantages will become apparent from a consideration of the ensuing descriptions and drawings.

DRAWING FIGURES

FIG. 1 is a cross sectional view of the straw with a flexible portion, and a buoy.

FIG. 2 is a cross sectional view of the telescopically engaged portion of the straw.

FIG. 3 is a perspective view of the carton with its top opened.

FIG. 4 is a cross sectional view of the carton with its top opened as in FIG. 3 showing the straw in place.

FIG. 5 is a perspective view of the "D" clamp.

FIG. 6 is a perspective view of the straw retainer.

FIG. 7 is a cross sectional view of the carton with its top being folded in the dotted lines with the straw inside.

FIG. 8 is a perspective view of the carton in FIG. 7 with the straw in place.

FIG. 9 is a cross sectional view of carton with the straw installed and the beverage poured.

FIG. 10 is a cross sectional view of the final product.

FIG. 11 is a perspective view of the carton with its spout open, and the straw is being pulled up to make it longer.

FIG. 12 is a cross sectional view of the carton in FIG. 11 with the telescopic straw extended.

| Reference Numerals in Drawings | | | |
|---|---|---|---|
| 1. | outer straw | 12. | roof panel |
| 2. | flexible portion | 13. | gable panel |
| 3. | straw rim | 14. | roof panel |
| 4. | outer sraw ring | 15A. | fin seal |
| 5. | inner straw | 15B. | fin seal |
| 6. | ring | 16. | opening |
| 7. | inner straw ring | 17. | "D" clamp |
| 8. | floating ball or buoy | 18. | straw retainer |
| 9. | side wall | 19. | surface of liquid |
| 10. | gable panel | 20. | liquid |
| 10A. | fold back panel | | |
| 10B. | fold back panel | | |
| 11. | side wall | | |

DESCRIPTION OF FIGURES

After the straw is put in place as in FIG. 4, the gable panel 10 is pushed and folded as in FIG. 7, bending the straw.

In the manufacturing process, the beverage is poured into the carton in a matter of seconds causing enormous pressure in the carton. However, since the tip of the "D" clamp 17 pushes the flexible portion 2 against the bent portion of gable panel 10 and side wall 9 the straw will be tightly secured in its position.

Figure 1:
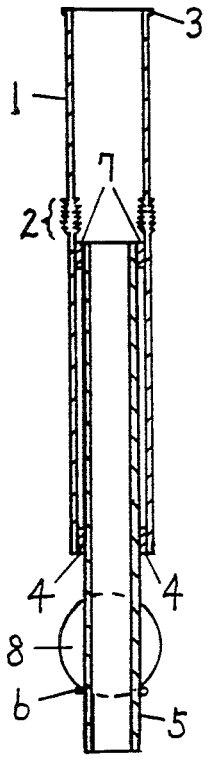
FIG. 1 discloses the straw with a flexible portion 2, a floating ball 8, a ring 6, and the straws 1 and 5 telescopically engaged. The ring 6 serves to hold the floating ball 8 from slipping down the straw 5. The floating ball 8 is made of a material of a lesser specific gravity than water to give buoyancy means to it.
Figure 2:
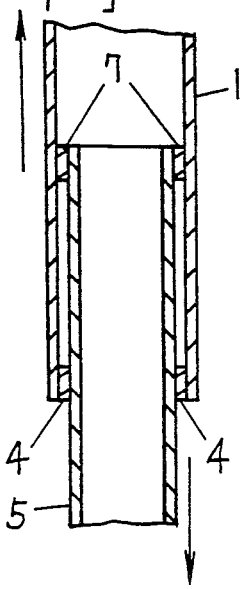
FIG. 2 discloses the engagement of the straws 1 and 5. A ring 4 is put internally around the straw 1 and ring 7 is put externally around the straw 5 so that, when straw 5 is put in the straw i, rings 7 and 4 are going to hold the straws from separating when the straw are extended.
Figure 3:
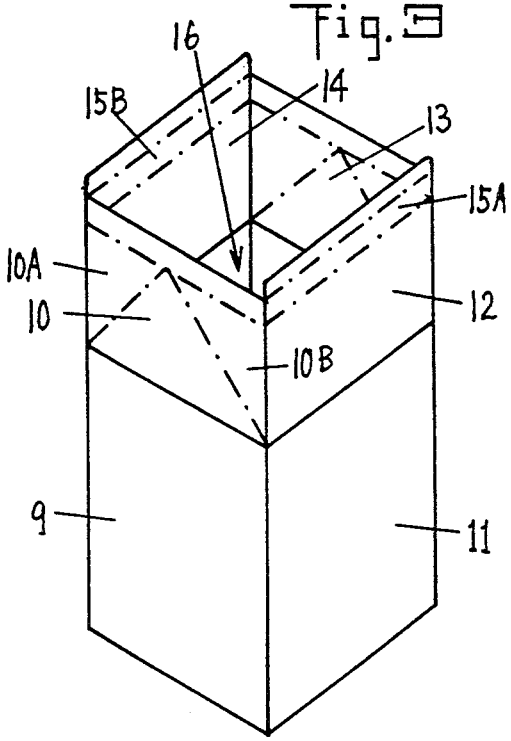
FIG. 3 discloses all the parts of the carton.
Figure 5:
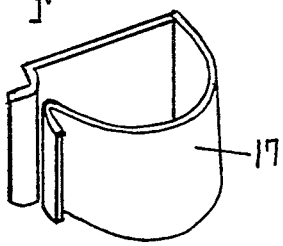
FIG. 5 and FIG. 6 discloses the "D" clamp 17 and the straw retainer 18 more in details. The straw retainer and the "D" clamp can be made of paper, plastic or any other suitable material. The "D" clamp 17 is located approximately in the middle of the triangular shape of gable panel 10, and the straw retainer 18 is located at the bottom center of side wall 9, so that "D" clamp 17 and straw retainer 18 are positioned on a "straight line" to receive the straw 1. The "D" clamp should hold the straw loosely so that the straw could come up immediately when the carton is opened.
Figure 4:
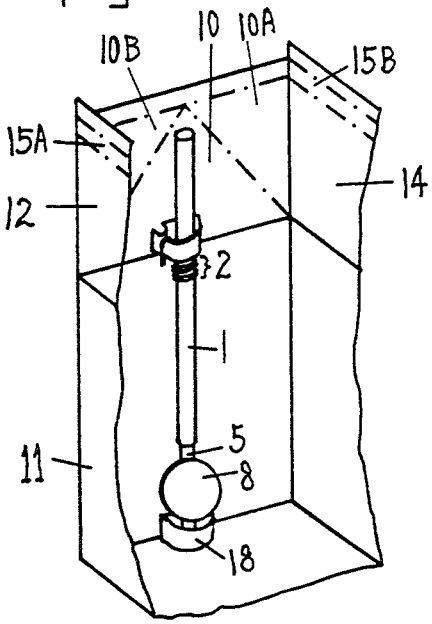
FIG. 4 discloses the straw attached by the "D" clamp 17 and the straw retainer 18 to the side wall 9 and gable panel 10. The straw is attached to the side wall in which the spout is located.
Figure 6:
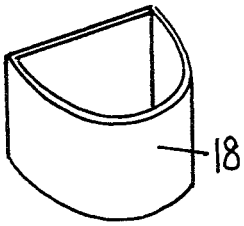
Figure 7:
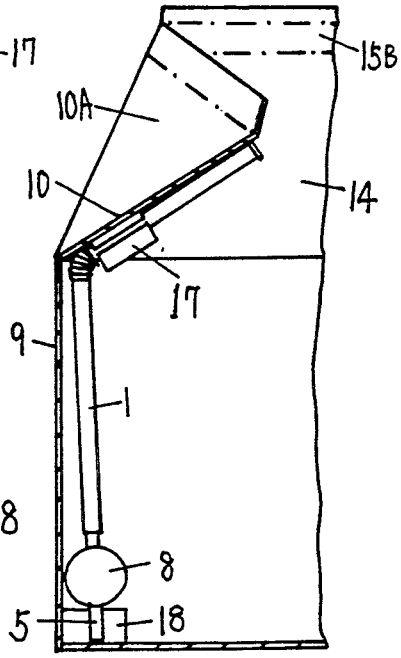
Figure 8:
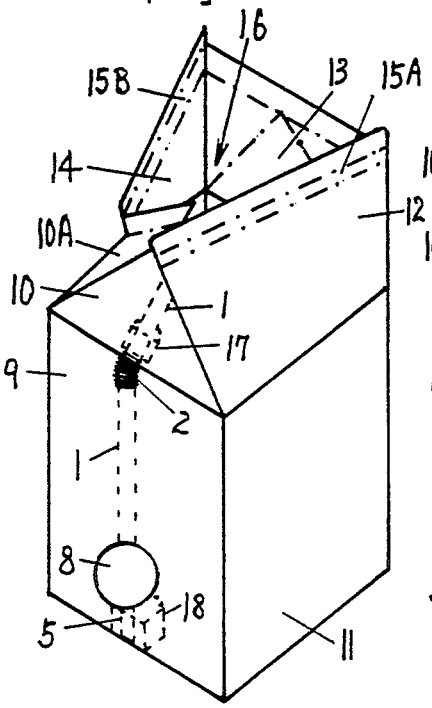
FIG. 8 discloses the carton in FIG. 7, seen from above. The straw is bent in order to prevent it from floating up while the beverage is being poured. With the straw 1 bent and the gable panel 10 pushed in, the gable panel 13 is not yet folded leaving an opening opposite to the side wall 9 in which the straw is located. The beverage is poured through that opening.
Figure 9:
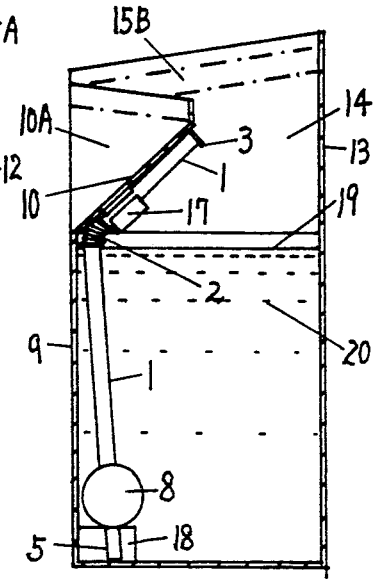

FIG. 9 discloses the carton with the gable panel 10 folded and with the beverage poured in.

Figure 10:
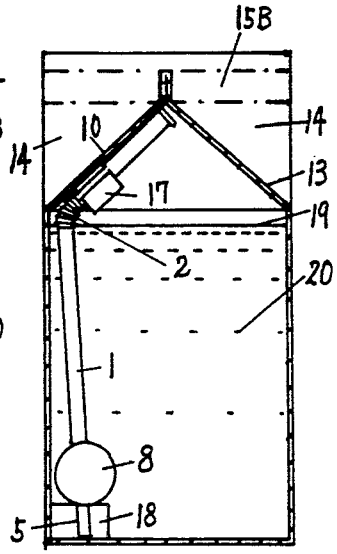
Figure 11:
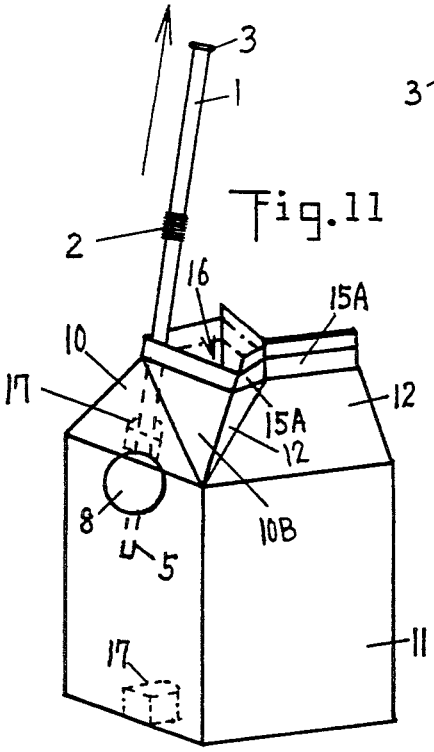

FIG. 10 discloses a completely sealed carton which is the final product that will be available to consumers. FIG. 11 discloses an open carton with the straw 1 ready for drinking.

Figure 12:
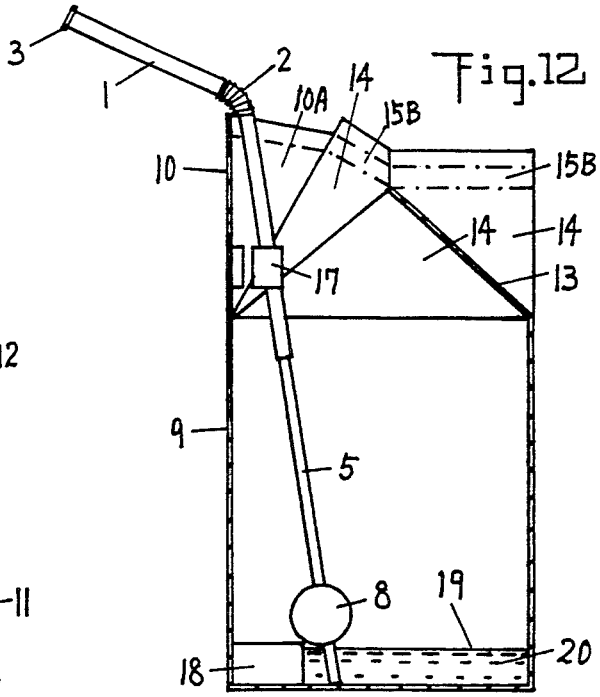

FIG. 12 discloses a carton with the straw extended to be able to reach the beverage when the level of the liquid goes down.

OPERATION

The manner of using the Beverage Carton with Telescopic Floating Straw is very simple. The consumer will buy the product like the one illustrated in FIG. 10 . All he/she has to do is open the carton as with any other beverage carton available in the market. At that moment, as the gable panel 10 is being unfolded the flexible portion of the straw is unbent. As soon as the spout is fully open the straw will come up immediately to an ideal drinking position such as in FIG. 11 providing convenience and simplicity to consumers.

While drinking the beverage, if the consumer needs a longer straw to reach the bottom of the carton when the level of the liquid goes down all he/she has to do is pull the straw up with the lips. Then, the straw will extend like a telescope as FIG. 12 shows.

SUMMARY, RAMIFICATIONS, AND SCOPE

Accordingly, the reader will see that the Beverage Carton With Telescopic Floating Straw provides an easy and convenient way of drinking from a carton. Furthermore, it has additional advantages in that:

it permits consumers to drink from beverage cartons without their fingers ever touching the straw;

it provides consumers with a floating straw that comes up to an ideal drinking position every time the carton is opened;

it provides a "D" clamp and a straw retainer that will securely hold the straw in place even during impacts caused by transportation, until the moment the consumer opens the carton.

Although the description above contains many specificities, these should not be construed as limiting the scope of the invention but as merely providing illustrations of some of the presently preferred embodiments of this invention. For example, the buoy can have other shapes and so as the straw retainers, etc.

Thus the scope of the invention should be determined by the appended claims, rather than by examples given.

What I claim is:

1. In combination, a gable top beverage carton arrangement containing:

(a) an extendable straw having a flexible portion, a float made of a material of a lesser gravity than water, and a ring on said straw to retain said float on said straw, (b) a D-shaped clamp situated internally on a gable panel of said carton and straw retainer situated at a bottom wall of said carton, so that said straw is held vertically by both the D-shaped clamp and the straw retainer, said extendable straw consisting of outer and inner telescopically engaged tubes; a second ring internally around the outer tube and third ring externally around the inner tube so that, when the tubes are telescopically engaged, the second and third rings will hold the tubes from separating when the straw is extended; the flexible portion of said straw positioned approximately between the gable panel and a side wall of said carton, so that when the gable panel is folded, the straw is bent, and the folded gable panel holds the straw from floating up.

* * * * *